US008984705B2

(12) United States Patent
Bosses

(10) Patent No.: US 8,984,705 B2
(45) Date of Patent: Mar. 24, 2015

(54) VACUUM CLEANER OUTER SHELL FRAGRANCE DISPENSER ASSEMBLY

(75) Inventor: Mark D. Bosses, Boca Raton, FL (US)

(73) Assignee: Zenith Technologies, LLC, Fort Lauderdale, FL (US)

( * ) Notice: Subject to any disclaimer, the term of this patent is extended or adjusted under 35 U.S.C. 154(b) by 931 days.

(21) Appl. No.: 13/046,348

(22) Filed: Mar. 11, 2011

(65) Prior Publication Data

US 2012/0227208 A1 Sep. 13, 2012

(51) Int. Cl.

| | |
|---|---|
| ***A47L 9/00*** | (2006.01) |
| ***A61L 9/02*** | (2006.01) |
| ***A62C 15/00*** | (2006.01) |
| ***A61J 15/00*** | (2006.01) |
| ***A62B 7/08*** | (2006.01) |
| ***A47L 7/04*** | (2006.01) |

(52) U.S. Cl.
CPC .... *A47L 7/04* (2013.01); *A47L 9/00* (2013.01)
USPC ..... 15/246.3; 15/320; 15/323; 15/339; 422/123; 239/8; 239/55; 239/57

(58) Field of Classification Search
USPC ..... 15/320, 323, 339, 246.2, 246.3; 422/122, 123, 125; 239/8, 55, 57
IPC ..... A47L 9/00; A61L 9/02; A62C 5/02; A61J 15/00; A62B 7/08
See application file for complete search history.

(56) References Cited

U.S. PATENT DOCUMENTS

| | | | | |
|---|---|---|---|---|
| 4,387,849 | A * | 6/1983 | Van Loveren et al. | 239/6 |
| 5,511,278 | A | 4/1996 | Shorthill | |
| 6,511,548 | B1 | 1/2003 | Oreck | |
| 7,093,773 | B2 | 8/2006 | Kuiper | |
| 2006/0090290 | A1 | 5/2006 | Lau | |

OTHER PUBLICATIONS

International Search Report dated Aug. 23, 2012 issued in PCT/US12/28403.

* cited by examiner

*Primary Examiner* — David Redding
(74) *Attorney, Agent, or Firm* — Roylance, Abrams, Berdo & Goodman, L.L.P.

(57) ABSTRACT

The present invention provides a fragrance dispenser assembly in the inside of an outer shell. The dispenser includes a bracket, a shelf and a fragrance dispensing unit located within an outer shell. The shelf may have a releasable attachment mechanism for the fragrance dispenser unit. The invention also includes the fragrance dispenser unit and a fragrance source.

22 Claims, 6 Drawing Sheets

VACUUM CLEANER OUTER SHELL FRAGRANCE DISPENSER ASSEMBLY

FIELD OF THE INVENTION

The present invention relates to a fragrance dispenser assembly for a vacuum cleaner outer shell.

BACKGROUND OF THE INVENTION

The use of fragrances with vacuum cleaners is generally well known in the art. However, a fragrance dispenser assembly for an outer shell for a vacuum cleaner as described in the present invention is not known in the prior art.

SUMMARY OF THE INVENTION

The present invention provides a fragrance dispenser assembly in the inside bottom of the outer shell. The assembly will house a fragrance dispenser unit having a case enclosing a disposable fragrance blister. The fragrance blister may be designed to last 30 to 60 days before the liquid fragrance is completely released and dispersed from the blister, so that the fragrance expires generally at the same interval as the time between changes of the filter bag. The blister is a transparent polypropylene container with a micro porous membrane bottom. An aluminum release sheet covers the membrane, and just before installation into the vacuum, the user peels off the aluminum sheet to expose the porous membrane to the ambient environment.

The three current known methods of using fragrance producing means for vacuum cleaners are dry fragrance tablets, fragrance powder and micro encapsulated release paper. The method of the present invention uses liquid, which will dispense more potent, more even and longer lasting aromas. Also, by using a fragrance dispenser unit with the assembly, different fragrance sources may be switched out within the case of the unit.

In addition, the top shelf of the assembly simultaneously provides a top shelf for support for the filter bag within the outer shell, so that a more powerful vacuum may be used to bring debris into the filter bag.

BRIEF DESCRIPTION OF THE DRAWINGS

A more complete understanding of the present invention, and the attendant advantages and features thereof, will be more readily understood by reference to the following detailed description when considered in conjunction with the accompanying drawings, wherein like designations refer to like elements, and wherein.

DETAILED DESCRIPTION OF THE INVENTION

Figure 1:
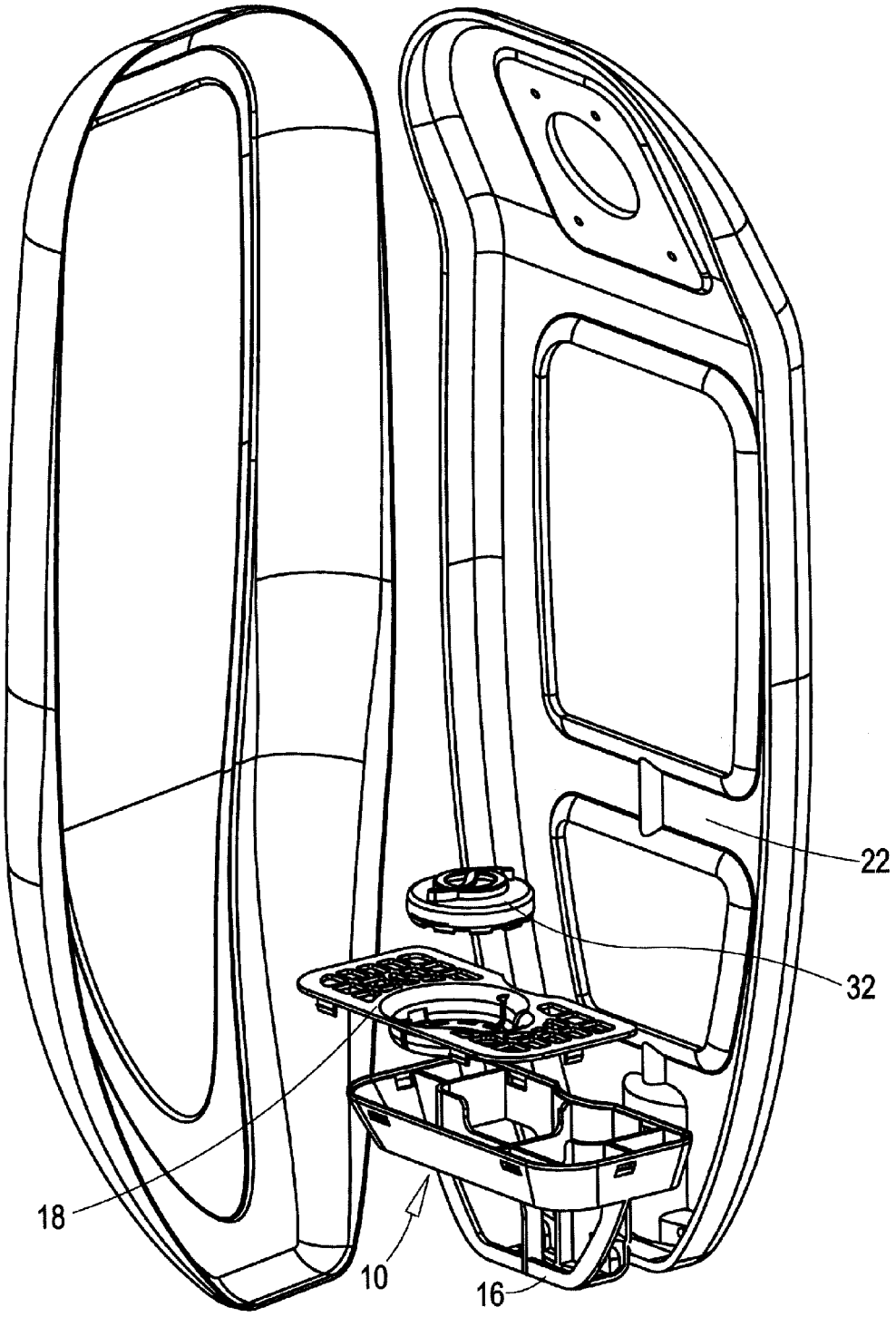
FIG. 1 is an exploded perspective view illustration of an embodiment of the present invention.
Figure 2:
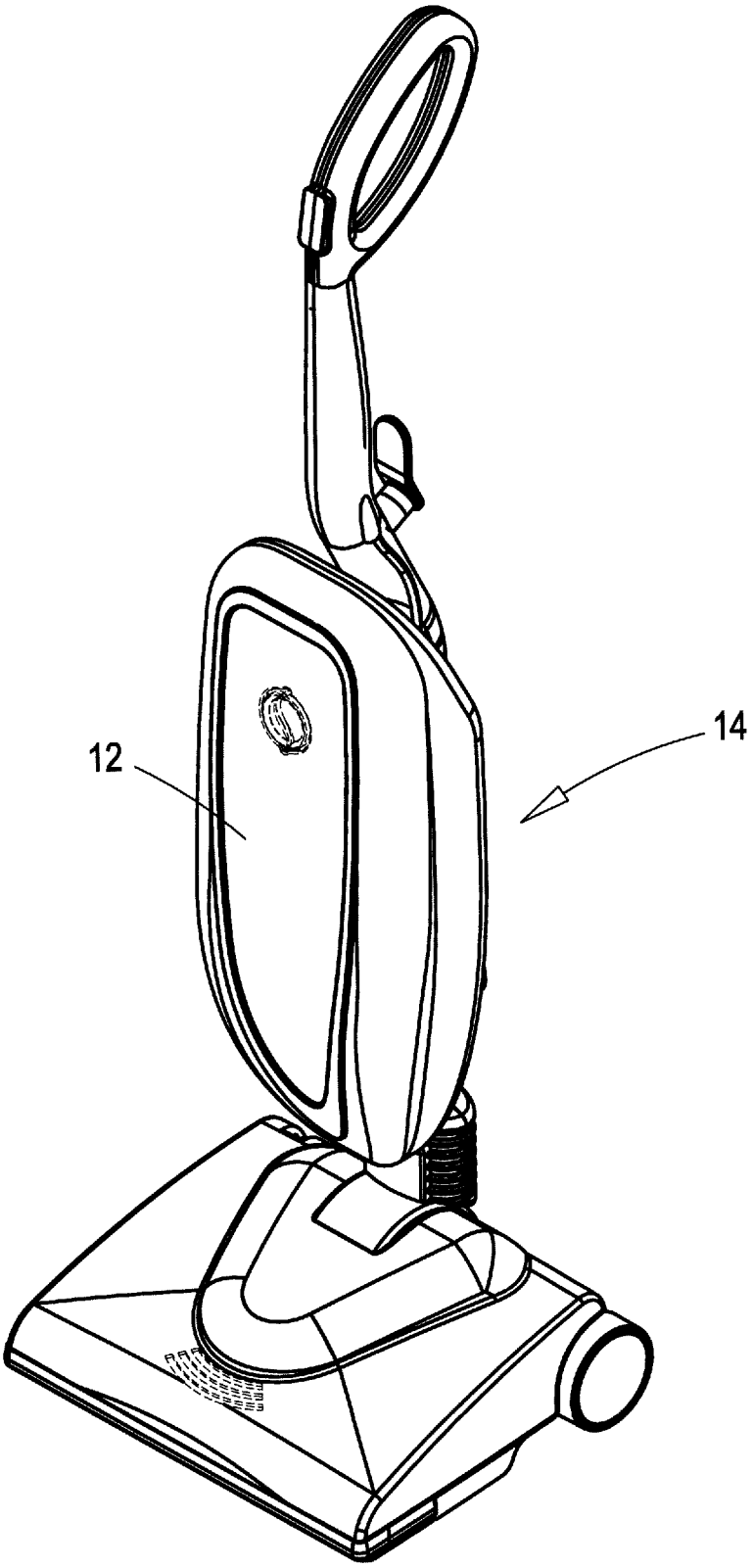
FIG. 2 is a perspective view of an illustration of an upright vacuum cleaner having the outer shell of an embodiment of the present invention.

FIG. 1 illustrates a fragrance dispenser assembly 10 according to an exemplary embodiment of the invention. The assembly 10 is located within an enclosable outer shell 12 for a vacuum cleaner 14 such as an upright vacuum cleaner, an example of which is shown in FIG. 2. The outer shell 12 may be a rigid and closeable bag. Alternatively, the outer shell 12 may be rigid or flexible. The vacuum cleaner 14 may be an upright or canister type vacuum cleaner. Also, the vacuum cleaner 14 may be a by-pass type (clean air) or direct-air type (dirty air) system. In this embodiment, the assembly 10 includes a bracket 16 having a top shelf portion 18 for use with a fragrance dispenser unit.

Figure 3:
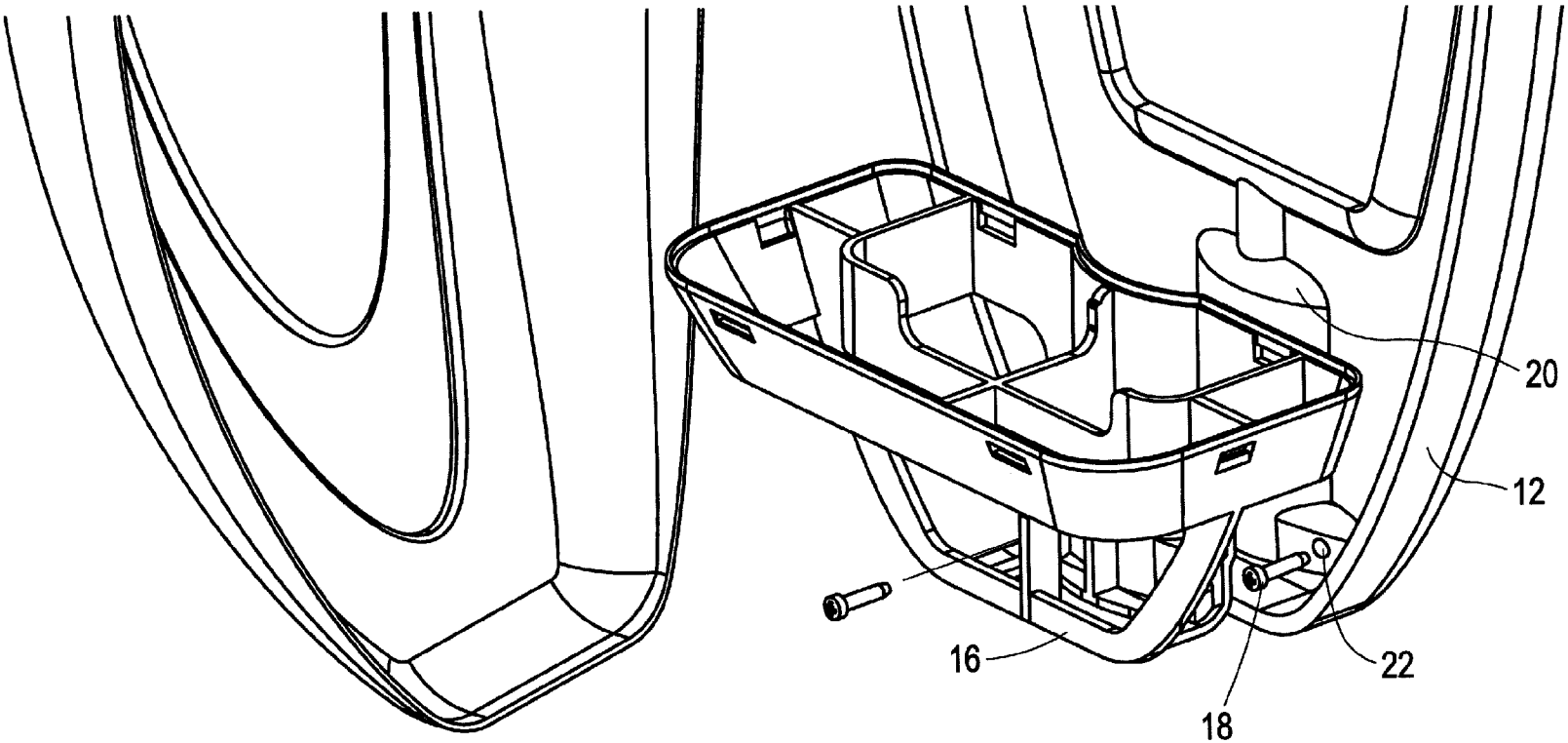
FIG. 3 is an exploded perspective view of a detail of a bracket of an embodiment of the present invention.

As shown in FIG. 3 the bracket 16 is attachable to an interior portion 20 of the outer shell 12. The bracket 16 may be securely fitted to the interior portion 20 with or without a physical connection attaching the bracket to the interior portion 20. The outer shell 12 may be generally flexible or rigid. The bracket 16 may be attached by attachment means 18 through an aperture 22 of the outer shell 12. The bracket 16 may be attached to the interior portion 20 of the outer shell 12 through means such as screws, pins, snap-fit connection, glue or other equivalent means known in the art. It may be preferred that the bracket 16 is attached to the framework of the vacuum cleaner 14 for even greater stability.

Figure 4A:
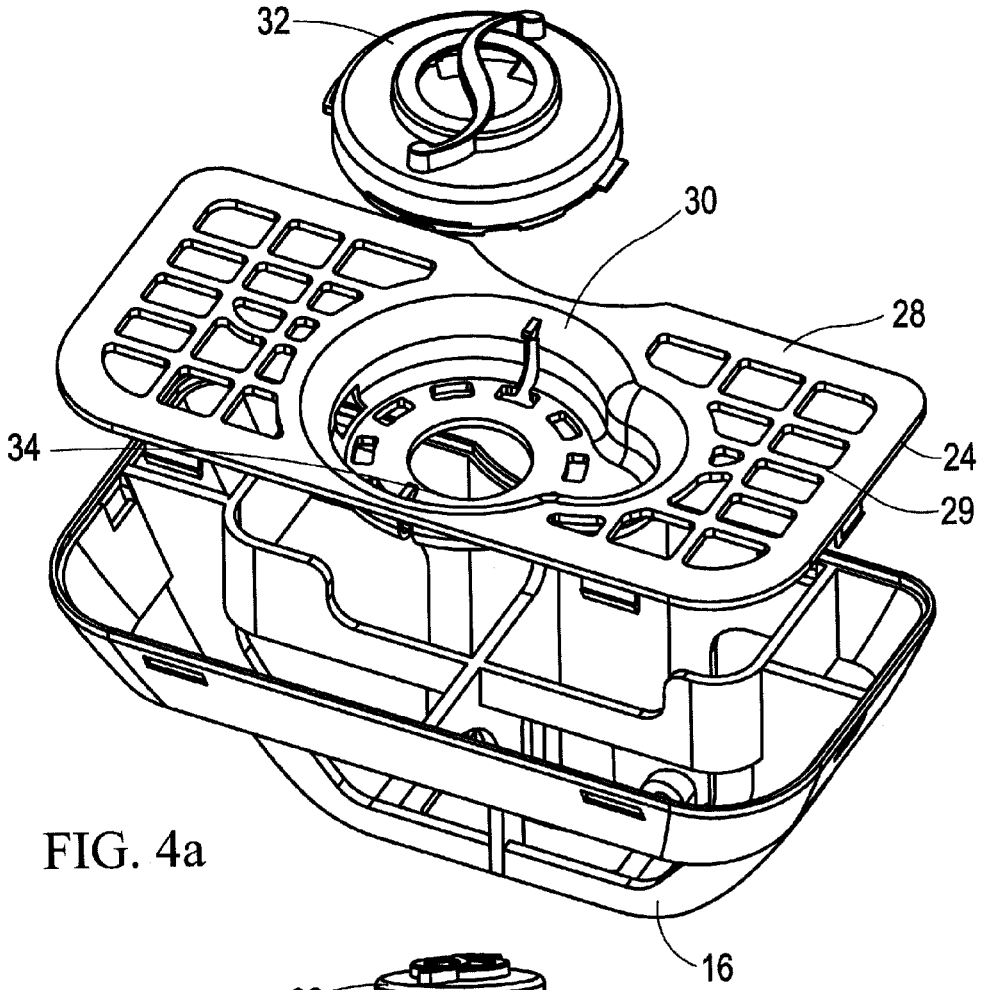
FIG. 4*a* is an exploded perspective view of the fragrance dispenser assembly of an embodiment of the present invention.
Figure 4B:
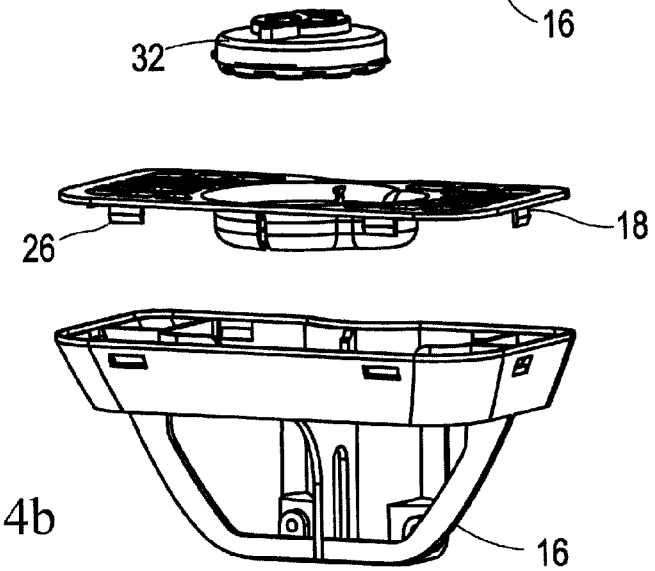
FIG. 4*b* is an exploded perspective view of the fragrance dispenser assembly of an embodiment of the present invention.
Figure 5:
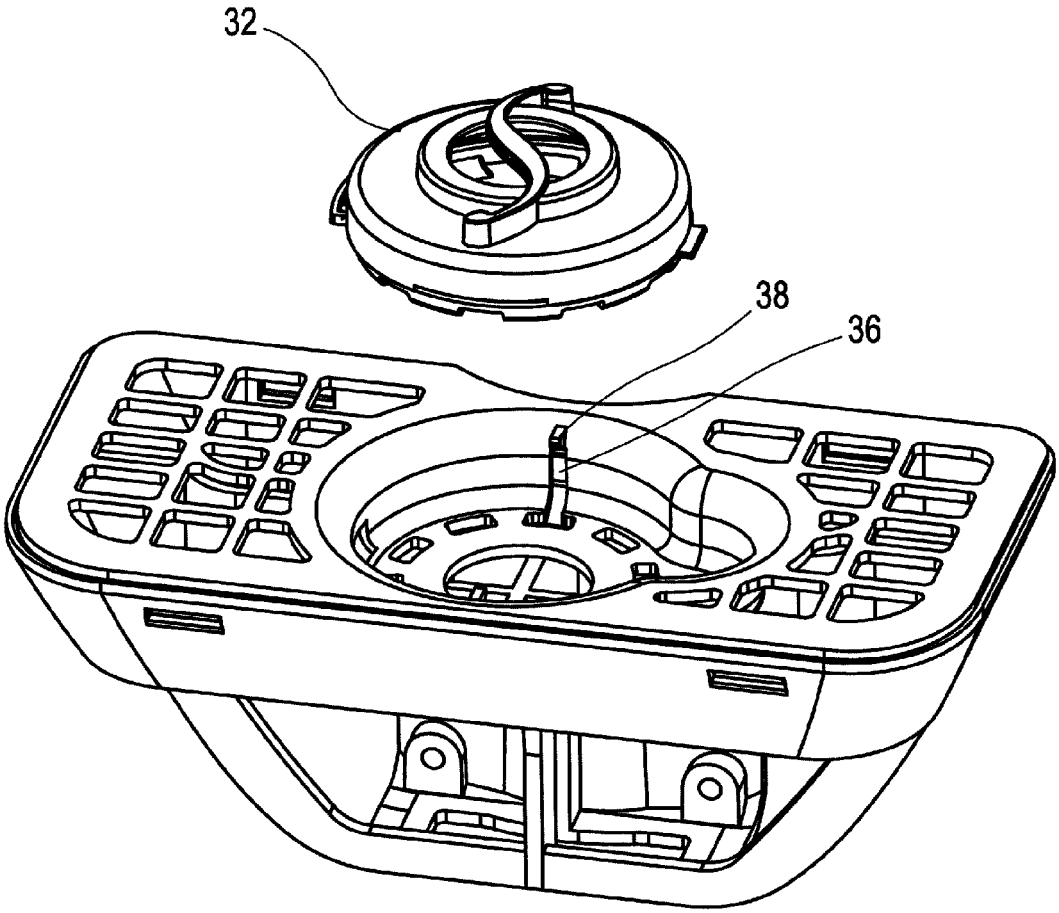
FIG. 5 is an exploded perspective view of the fragrance dispenser assembly of an embodiment of the present invention.

FIGS. 4*a* and 4*b* show exploded views of the fragrance dispenser assembly 10. The bracket 16 supports a top shelf 24. The top shelf 24 may be of sufficient area and rigidity to support a filter bag for the vacuum cleaner 14. As shown, the top shelf 24 is attached to the bracket 16 by attachment means 26 such as a snap-fit connection. However, other attachment means 26 known in the art such as glue or screws are also contemplated. It is also contemplated that the top shelf 24 and the bracket 16 may be formed together in one piece.

The top shelf 24 includes a top surface 28. The top surface 28 may also include perforations 29 for better dispersal of the fragrance to be used. As shown, the top surface 28 includes an indentation 30. The indentation 30 receives a fragrance dispenser unit 32. The indentation 30 as shown is generally round; however, other geometry is also contemplated. The indentation 30 may include a secondary notch 34 to facilitate removal of the fragrance dispenser unit 32.

In addition, the indentation 30 may include an attachment mechanism 36 for securing the fragrance dispenser unit 32 in the indentation 30. The attachment mechanism 36 may releasably secure the fragrance dispenser unit 32 or may secure the fragrance dispenser unit 32 to the indentation permanently. The attachment mechanism 36 may include one or more flanges 38 to overhang the fragrance dispenser unit 32 for greater security of the attachment between the fragrance dispenser unit 32 and the indentation 30.

Although an indentation 30 for receiving the fragrance dispenser unit 32 is shown, other embodiments are also contemplated. For example, a portion of the shelf may have a protrusion or other geometry and a bottom surface of the fragrance dispenser unit 32 may have an indentation or other complementary geometry to the protrusion. Also, the assembly 10 may also be used as a support for a filter bag within the outer shell 12.

Figure 6:
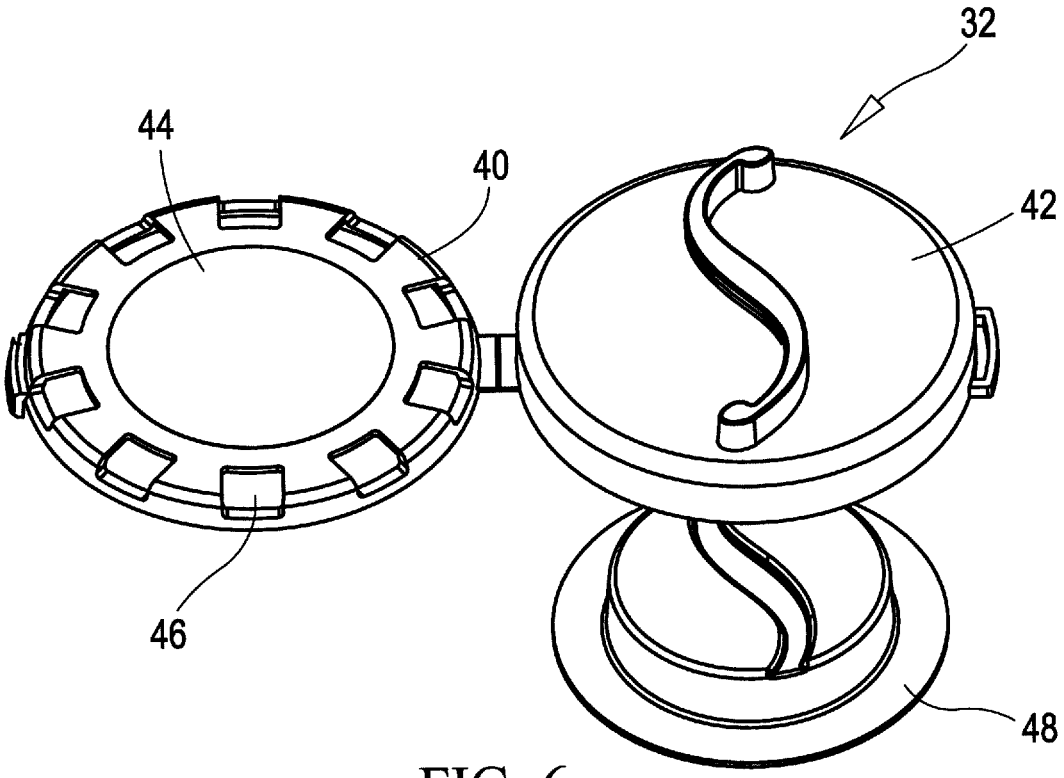
FIG. 6 is a perspective view of the fragrance dispenser unit assembly of an embodiment of the present invention.

FIG. 6 illustrates one embodiment of the fragrance dispenser unit 32 in detail. As shown, the fragrance dispenser unit 32 includes an openable outer case 40. The outer case 40 includes a top side 42 and a bottom side 44. The outer case 40 also may have perforations 46. A fragrance source 48 may be placed within the outer case 40. The perforations 46 and the concentration of scent in the fragrance source 48 may be manipulated so that the scent of the fragrance source 48 expires approximately simultaneously with an interval for which a filter bag would be changed for the vacuum cleaner. For example, the scent lasts 30 to 60 days before the liquid fragrance is completely released and dispersed, so that the fragrance expires generally at the same interval as the time between recommended changes of the filter bag for the vacuum cleaner 14.

In another embodiment, the fragrance source 48 is a fragrant liquid in a container, at least a portion of which is see-through (transparent or translucent). The container may be made of a material such as polypropylene or an equivalent. The container may include a microporous membrane bottom, where a release sheet covers the membrane. Before installation of the fragrance dispenser unit in the outer shell, a user may peel the release sheet to expose the porous membrane to the environment. By using a liquid fragrance source, the invention provides more variety of fragrances and more potent, more even and longer-lasting fragrances than have been known in the prior art.

The transparency or translucency of the container, or blister, allows a user to determine the level of liquid in the container without having to open the outer case. The other known technologies for providing fragrance within a vacuum cleaner, such as tablets, powder, patches or microencapsulated paper, do not provide the visual gauge for determining fragrance level that is provided in this invention. In addition, an aluminum release sheet covers the membrane, and just before installation into the vacuum, the user peels off the aluminum sheet to expose the porous membrane to the ambient environment.

It will be appreciated by persons skilled in the art that the present invention is not limited to what has been particularly shown and described hereinabove. In addition, unless mention was made to the contrary, it should be noted that all of the accompanying drawings are not to scale. A variety of modifications and variations are possible in light of the above teachings without departing from the scope and spirit of the invention, which is limited only by the following claims.

What is claimed is:

1. A vacuum cleaner fragrance dispenser assembly for a vacuum cleaner having an encloseable outer shell, comprising:

a bracket securely fitted to an interior portion of an outer shell of a vacuum cleaner; and a top shelf portion having a top surface and an indentation positioned below the top surface for receiving a fragrance dispenser unit accessible to a user from the interior portion of the outer shell.

2. The vacuum cleaner fragrance dispenser assembly of claim 1, wherein the bracket is securely fitted to an interior portion of the outer shell by a physical connection attaching the bracket to the interior portion of the outer shell.

3. The vacuum cleaner fragrance dispenser assembly of claim 1, wherein the indentation is generally round.

4. The vacuum cleaner fragrance dispenser assembly of claim 1, wherein the indentation further includes a secondary notch.

5. The vacuum cleaner fragrance dispenser assembly of claim 1, wherein the bracket is securably attached to the interior portion of the outer shell and a framework of the vacuum cleaner.

6. The vacuum cleaner fragrance dispenser assembly of claim 1, wherein the top shelf portion is releasably attachable to the bracket.

7. The vacuum cleaner fragrance dispenser assembly of claim 1, further comprising the fragrance dispenser unit received in the indentation.

8. The vacuum cleaner fragrance dispenser assembly of claim 7, wherein the fragrance dispenser unit comprises an outer case having a top side, a bottom side, and perforations on at least one of the top side and the bottom side.

9. The vacuum cleaner fragrance dispenser assembly of claim 8, wherein the fragrance dispenser unit further comprises a generally liquid fragrance source.

10. The vacuum cleaner fragrance dispenser assembly of claim 8, wherein the fragrance dispenser unit is openable.

11. The vacuum cleaner fragrance dispenser assembly of claim 1, wherein the indentation includes a releasable attachment mechanism.

12. The vacuum cleaner fragrance dispenser assembly of claim 11, wherein the attachment mechanism includes at least one flange.

13. The vacuum cleaner fragrance dispenser assembly of claim 12, wherein the flange overhangs a fragrance dispenser positioned in the indentation.

14. The vacuum cleaner fragrance dispenser assembly of claim 1, wherein the bracket is fitted to the interior portion of the shell so that a fragrance dispenser unit is removable from the interior portion of the outer shell.

15. An upright vacuum cleaner, comprising:

an encloseable outer shell having an inside volume; and a bracket securely fitted to an interior portion of the outer shell including a top shelf portion having a top surface and an indentation for receiving a fragrance dispenser unit accessible to a user from the interior portion of the outer shell.

16. The upright vacuum cleaner of claim 15, further comprising a fragrance dispenser unit located on the top surface.

17. The upright vacuum cleaner of claim 16, wherein the fragrance dispenser unit includes an openable outer case having a top side, and a bottom side, wherein at least one of the top side and the bottom side further includes perforations, and the liquid fragrance source is placeable within an interior of the outer case.

18. The upright vacuum cleaner of claim 17, wherein the fragrance source includes a microporous membrane barrier is connected to a container, and at least a portion of the container is see-through.

19. The upright vacuum cleaner of claim 18, wherein the liquid fragrance source comprises a scent concentration manipulated so that the scent expires approximately simultaneously with an interval for which a filter bag would be changed for the vacuum cleaner.

20. The upright vacuum cleaner of claim 15, wherein the bracket is securably attached to the interior portion of the outer shell and a framework of the vacuum cleaner.

21. A method of dispensing fragrance within an encloseable outer shell of a vacuum cleaner, comprising the steps of:

providing a bracket within an encloseable outer shell of an upright vacuum cleaner including a top shelf portion having a top surface and an indentation for receiving a fragrance dispenser unit accessible to a user from the interior of the enclosable outer shell; and placing a fragrance dispenser unit in the indentation.

22. The method of claim 21, wherein the fragrance dispenser unit comprises an outer case enclosing a fragrance source and further comprising replacing the fragrance source by removing the fragrance dispenser unit from the indentation, removing the fragrance source from the outer case, placing a second fragrance source in the outer case, and replacing the fragrance dispenser unit in the indentation.

* * * * *